US008166960B2

(12) United States Patent
Micieli et al.

(10) Patent No.: US 8,166,960 B2
(45) Date of Patent: May 1, 2012

(54) PLASTIC BOTTLE LAUNCHER

(75) Inventors: Mark G Micieli, Alexandria, VA (US); Charles W Wollman, Mechanicsville, VA (US)

(73) Assignee: Great American Projects, Inc., Mechanicsville, VA (US)

( * ) Notice: Subject to any disclaimer, the term of this patent is extended or adjusted under 35 U.S.C. 154(b) by 100 days.

(21) Appl. No.: 12/484,399

(22) Filed: Jun. 15, 2009

(65) Prior Publication Data

US 2010/0313865 A1 Dec. 16, 2010

(51) Int. Cl.
*F41B 11/00* (2006.01)

(52) U.S. Cl. ..... 124/73

(58) Field of Classification Search ..... 124/56, 124/57, 73

See application file for complete search history.

(56) References Cited

U.S. PATENT DOCUMENTS

| | | | | | |
|---|---|---|---|---|---|
| 2,409,653 | A | * | 10/1946 | Amdur | 124/63 |
| 2,733,699 | A | * | 2/1956 | Krinsky | 124/69 |
| 3,962,818 | A | * | 6/1976 | Pippin, Jr. | 446/212 |
| 4,223,472 | A | * | 9/1980 | Fekete et al. | 446/192 |
| 5,415,153 | A | * | 5/1995 | Johnson et al. | 124/63 |
| 5,538,453 | A | * | 7/1996 | Johnson | 446/176 |
| 5,653,216 | A | * | 8/1997 | Johnson | 124/69 |
| 5,839,940 | A | * | 11/1998 | Ensmenger | 446/212 |
| 6,321,737 | B1 | * | 11/2001 | Johnson et al. | 124/73 |
| 6,347,623 | B1 | * | 2/2002 | Kownacki et al. | 124/56 |
| 6,460,531 | B1 | * | 10/2002 | Gourley et al. | 124/64 |

* cited by examiner

*Primary Examiner* — Troy Chambers

(57) ABSTRACT

A projectile launching system is provided. The system comprises: a projectile; a string for releasing the projectile; and a device for projecting a projectile. The device comprises: a base having a seat for placing the projectile; an air intake duct in fluid communication with the seat; and a pressure release element disposed between the base and the air intake duct.

11 Claims, 2 Drawing Sheets

PLASTIC BOTTLE LAUNCHER

FIELD OF THE INVENTION

This invention relates to an apparatus and methods for launching a projectile, more specifically this invention relates to an apparatus and methods for launching a plastic bottle.

BACKGROUND

Plastic bottle launching is known. However there is a need for an improved standard and safe launcher.

SUMMARY OF THE INVENTION

There is provided an improved novel apparatus and methods for launching a projectile.

There is provided an improved novel apparatus and methods for launching a projectile using a check valve to release pressure.

There is provided an improved novel apparatus and methods for launching a projectile having the projectile only partially filled with air.

A device for projecting a projectile is provided. The device comprises: a base having a seat for placing the projectile; an air intake duct in fluid communication with the seat; and a pressure release element disposed between the base and the air intake duct.

A projectile launching system is provided. The system comprises: a projectile; a string for releasing the projectile; and a device for projecting a projectile. The device comprises: a base having a seat for placing the projectile; an air intake duct in fluid communication with the seat; and a pressure release element disposed between the base and the air intake duct.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
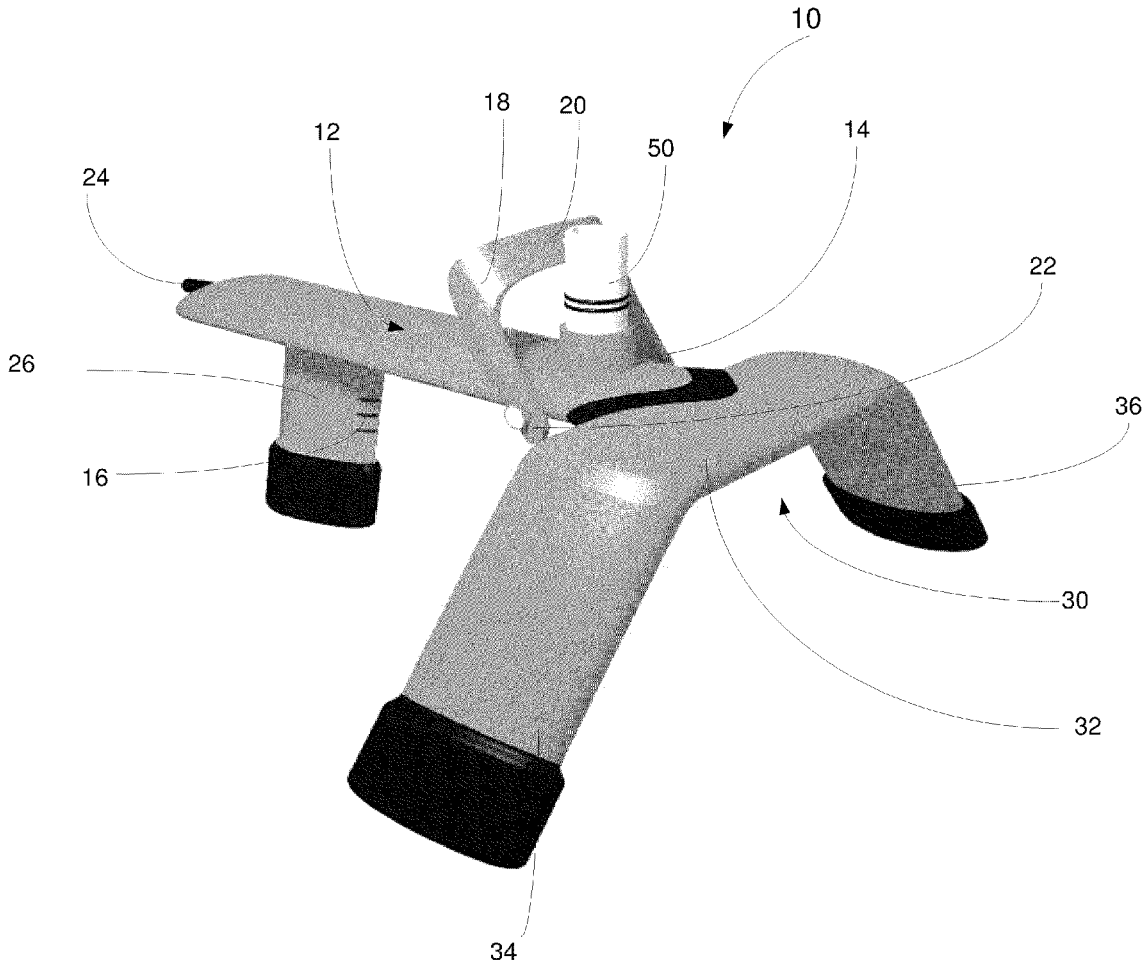
FIG. 1 illustrates an example of a projectile launcher in accordance with the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to projectile launching. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element. Referring to FIG. 1, an embodiment of the present invention is shown. A device 10 for projecting a projectile (not shown) is depicted. Device 10 comprises a base or main body 12 having a seat 14 for placing the projectile. A pressure release element 16 in fluid communication with the seat 14 is provided. Main body 12 has an elongated shape with an air intake mouth 24 formed at a first end and seat 14 formed at a second or opposite end. An air communication duct (see FIG. 2) facilitating the fluid communication between intake mouth 24 and seat 14. A pressure release element 16 is disposed between the base 12 and the air intake mouth 24.

Pressure release element 16 is a vent primarily for releasing pressure via the check valve, and is not an air intake of any kind. Air goes in the valve stem or intake mouth 24.

Device 10 further comprises a securing element 18 for securing the projectile with the securing element 18 disposed to release the securing, whereby the projectile is released upon lunching.

The securing element is a device having a proximal end 22 hinged proximally to the seat 14, and a distal end 20 in touch and securing the projectile. An elongated element (not shown) such as a string may be affixed onto the distal end 20. An operator (also not shown) at a distance pulls the string to release the securing whereby the projectile is released upon lunching. A main body 12 is elongated in shape and has a proximal end and a distal end, with the seat formed upon the proximal end and with the distal the air intake mouth formed thereon 24. A third leg 26 is formed on main body 12.

Device 10 further comprising, auxiliary body 30 is elongated in shape and has a center 32, a first end 34, and a second end 36; the center 32 being integrally connected to the proximal end of the main body 12, the first end 34 and second end 36 both banded to form a first leg and second leg respectively.

The projectile comprises a plastic bottle disposed to receive intake air. In the preferred embodiment, the bottle is partially filled with water. The projectile comprises a plastic bottle partially filled with liquid disposed to receive intake air.

Figure 2:
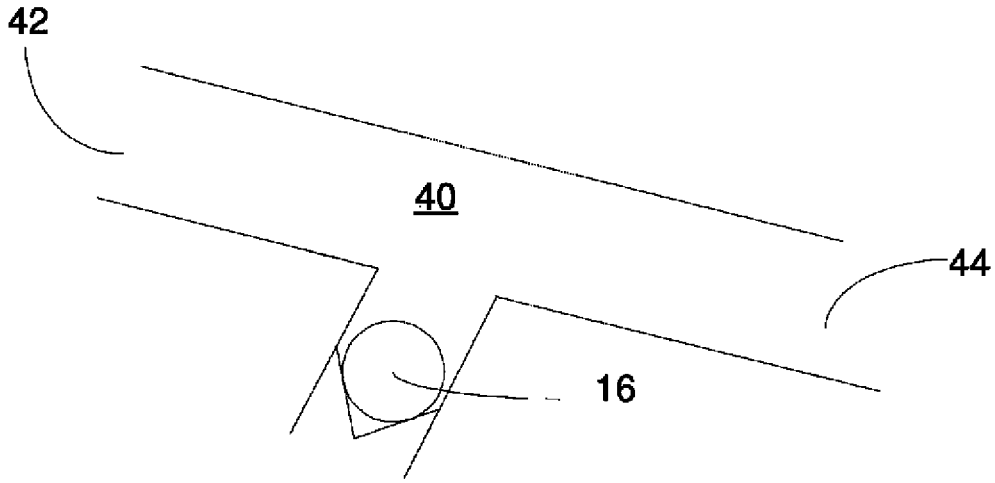
FIG. 2 is a detailed depiction of FIG. 1.

Referring to FIG. 2, a partial, detailed air duct of the present invention is shown. Main duct 40 is in fluid communication with the pressure release element 16. Duct 40 comprises a first end 42 and a second end 44. First end 42 extends to air intake mouth 24. Second end 44 extends to seat 14. Pressure release element 16 comprises a check valve. On top of seat 14, an accommodator 50 is formed thereon for accommodating or placing a plastic bottle. Accommodator 50 may have one or more O-rings formed thereon for sealing or stabilizing purposes.

In one example, the bottle launcher of the present invention is designed to launch a typical 2 liter plastic bottle straight up into the air utilizing water and/or compressed air as propellant. The launcher is made of plastic and has a tripod configuration with a T design (top view). A vertical launch tube is formed on top, and a check valve (high pressure release) is installed inside the front leg with vents. A latch, also made of plastic is installed that is fit over the lip of the plastic bottle before launch to hold the bottle until launch. A typical bicycle pump is utilized to pressurize the bottle to approximately 60 psi, wherein the check valve releases excess pressure. The bottle is then ready for launch. One just pulls the string attached to the launch latch to release the bottle into flight.

Typically, the bottle launcher is made of injection molded plastic into a tripod design. A top down view would indicate a T configuration. A very unique feature of the present invention n is the check valve (high pressure release) that is installed in the front leg. The valve prohibits the launcher and the bottle from being over pressurized and possibly exploding.

The latch mechanism also allows the person(s) launching the bottle to release the bottle at will instead of automatically or uncontrollably, when the pressure is sufficient to release on its own as that of other known launchers. The shape of this launcher is unique in that it gives a futuristic perception of a space ship rather than simple PVC tubing.

In addition, the launcher itself requires no assembly. It is ready to use as is.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. A device for projecting a projectile, said device comprising:

a base having a seat and a main duct, said seat being arranged to receive the projectile;

an air intake duct having an air intake mouth in fluid communication with said seat via said main duct; and a check valve in fluid communication with said main duct and being operable to maintain a predetermined pressure and to release excessive pressure beyond the predetermined pressure, the predetermined pressure being able to launch the projectile.

2. The device of claim 1, further comprising a securing element operable to secure the projectile and being disposed to release said securing, whereby the projectile is released upon launching.

3. The device of claim 2, wherein said securing element comprises a device having a proximal end and a distal end, said proximal end being hinged proximally to said seat, said distal end being in touch with and securing the projectile.

4. The device of claim 1, wherein said base comprises a main body and a leg, said main body having an being elongated in shape and having a proximal end and a distal end, wherein said seat is disposed at said proximal end, and wherein said leg is disposed at said distal end.

5. The device of claim 4 further comprising:

an auxiliary body having a center, a first end, and a second end, the center being connected to said proximal end, wherein said first end forms a second leg, and wherein said second end forms a third leg.

6. A projectile launching system for use with a projectile, said projectile launching system comprising:

a device including a base, an air intake duct and a check valve; and a release mechanism connected to said device, wherein said base includes a seat arranged for receiving the projectile, wherein said air intake duct includes an air intake mouth in fluid communication with the said seat, and wherein said check valve is disposed between said base and said air intake mouth, is in fluid communication with said main duct, is operable to maintain a predetermined pressure and is operable to release excessive pressure beyond the predetermined pressure, the predetermined pressure being able to launch the projectile.

7. The system of claim 6, further comprising a securing element operable to secure the projectile and being disposed to release said securing, whereby the projectile is release upon launching.

8. The system of claim 7 wherein said securing element comprises a device having a proximal end and a distal end, said proximal end being hinged proximally to said seat, said distal end being in touch with and securing the projectile.

9. The system of claim 6, wherein said base comprises a main body and a leg, said main body having an being elongated in shape and having a proximal end and a distal end, wherein said seat is disposed at said proximal end, and wherein said leg is disposed at said distal end.

10. The system of claim 6, further comprising:

an auxiliary body having a center, a first end, and a second end, the center being connected to said proximal end, wherein said first end forms a second leg, and wherein said second end forms a third leg.

11. A device for projecting a projectile, said device comprising:

a base having a seat and a main duct, said seat being arranged to receive the projectile;

an air intake duct having an air intake mouth in fluid communication with said seat via said main duct; and a check valve in fluid communication with said main duct and being operable to maintain a predetermined pressure and to release excessive pressure beyond the predetermined pressure, the predetermined pressure being able to launch the projectile, wherein said seat includes an accommodator operable to accommodate the projectile, and wherein said accommodator comprises an O-ring operable to seal the projectile to said seat.

* * * * *